US008506333B2

(12) United States Patent
Wang et al.

(10) Patent No.: US 8,506,333 B2
(45) Date of Patent: Aug. 13, 2013

(54) CONNECTOR ASSEMBLY HAVING FRONT AND REAR ROWS OF TERMINALS WITH DIFFERENTLY LEVELED CONTACTING PORTIONS

(75) Inventors: Chien-Chiung Wang, New Taipei (TW); Qing-Man Zhu, Kunshan (CN); Xue-Liang Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/302,153

(22) Filed: Nov. 22, 2011

(65) Prior Publication Data

US 2012/0129402 A1 May 24, 2012

(51) Int. Cl.
*H01R 24/00* (2011.01)

(52) U.S. Cl.
USPC ..... 439/626

(58) Field of Classification Search
USPC ..... 439/260, 626, 632, 180
See application file for complete search history.

(56) References Cited

U.S. PATENT DOCUMENTS

| | | | | |
|---|---|---|---|---|
| 5,730,609 | A | 3/1998 | Harwath et al. | |
| 6,368,129 | B1 | 4/2002 | Wang et al. | |
| 6,402,556 | B1 | 6/2002 | Lang et al. | |
| 7,798,820 | B2 | 9/2010 | Hong | |
| 2012/0040563 | A1 * | 2/2012 | Wang et al. | 439/626 |

* cited by examiner

*Primary Examiner* — Chandrika Prasad
(74) *Attorney, Agent, or Firm* — Ming Chieh Chang; Wei Te Chung

(57) ABSTRACT

A connector assembly has a receptacle connector and a plug connector adapted for inserting in the receptacle connector. The receptacle connector (100) includes housing (140), a first terminal (162) and a second terminal (164) secured in the housing. The second terminal is lower than the first terminal. The plug connector includes a paddle board (200) having a first conductive member (242) and a second conductive member (244). The second conductive member is higher than the first member. The first terminal contacts with the first conductive member, and the second terminal contacts with the second conductive member. The paddle board is capable of inserting into the housing easily and protecting the terminals and the paddle board.

6 Claims, 11 Drawing Sheets

CONNECTOR ASSEMBLY HAVING FRONT AND REAR ROWS OF TERMINALS WITH DIFFERENTLY LEVELED CONTACTING PORTIONS

BACKGROUND OF THE INVENTION

1. Field of the Invention

The present invention relates to a receptacle connector and a plug connector, and more particularly to a SFP (Small Form-Factor Pluggable) receptacle connector and a plug connector mating with the receptacle connector. The application relates to the copending application Ser. No. 13/210,601 filed Aug. 16, 2011 having the same assignee with the invention.

2. Description of Related Art

U.S. Pat. No. 7,798,820 issued to Hong on Sep. 21, 2010 discloses a receptacle connector comprising an inserting slot for insertion of a plug, a first and a second terminals disposed at a lower side of the insertion slot and aligned with each other along a mating direction. The first terminals are disposed in front of the second terminals at the inserting direction. A paddle board of the mating plug has an upper face, a row of first pads and a row of second pads disposed at the upper face and aligned with each other along the mating direction. The first pads are disposed in front of the second pads at the inserting direction. The first and the second pads are arranged at a same horizontal face. The first terminals contact with the first pads, and the second terminals contact with the second pads. U.S. Pat. Nos. 5,730,609, 6,368,129 and 6,402,556 also disclose two rows of terminals in a receptacle connector for contacting with two rows of pads on a paddle board.

In these prior arts, the contact portions of a first and a second terminals are aligned with each other, and a first and a second pads are arranged at a same horizontal face. When the paddle board is inserted in the inserting slot, the second terminals contact with the first pads firstly. In further insertion, the second terminals engage with the paddle board. The second terminals may cause damage to the board or break themselves. The paddle board may also experience difficulty in inserting into the receptacle connector.

Hence, a receptacle connector having improved contact modules and a mating plug having a paddle board is desired.

SUMMARY OF THE INVENTION

Accordingly, an object of the present invention is to provide a receptacle and a plug connector mating easily with each other, and keeping close fit between the terminals and the pads without damaging the paddle board or contact portions of the terminals.

In order to achieve the object set forth, the invention provides a receptacle connector and a plug connector inserting in the receptacle connector along an inserting direction. The receptacle connector comprises a housing defining an inserting slot and a cavity communicating with the inserting slot, a row of first terminals received in the cavity and secured in the housing, and a row of second terminals received in the cavity and secured in the housing. Each of the first terminals has a first contact portion for mating with the paddle board, and each of the second terminals has a second contact portion for mating with the paddle board. The first contact portions and the second contact portions are disposed at a first side of the inserting slot. The first contact portions are disposed in front of the second terminal at the inserting direction, and higher than the second contact portions at another direction perpendicular to the inserting direction.

The plug connector comprises a paddle board having a first side, a second side and a mating edge. A row of first conductive members and a row of second conductive members are arranged at the first side. The first conductive members are closer to the mating edge than the second conductive members. The second conductive members are higher than the first conductive members along a direction from the second side to the first side.

The second contact portions are lower than the first contact portions, and the second conductive members are higher than the first conductive members. Therefore, the paddle board is capable of inserting easily into the housing without engaging with the second terminals and protecting the terminals and the paddle board.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-8, a connector assembly according to a first embodiment of the present invention is shown. The connector assembly includes a receptacle connector and a plug connector adapted for mating with the receptacle connector. The receptacle connector includes a receptacle 100, and a shielding cage (not shown) attached to the receptacle 100. The plug connector includes a top shell (not shown), a bottom shell (not shown), a recess (not shown) defined by the two shells, and a paddle board 200 received in the recess. In order to better show the present invention, only the paddle board 200 and the receptacle 100 are shown in the figures.

Figure 1:
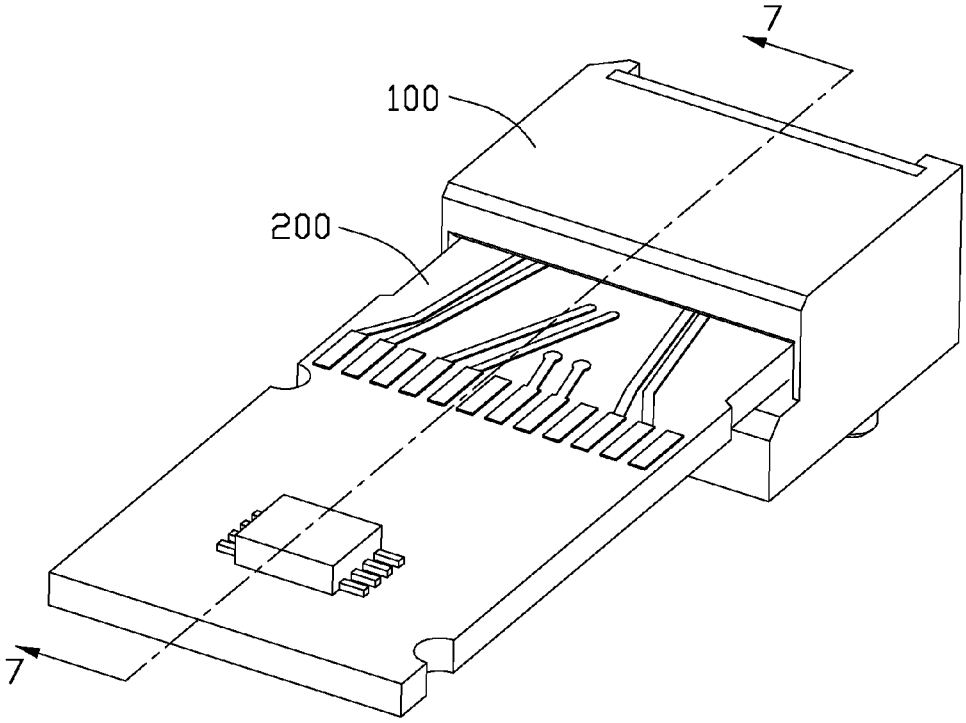
FIG. 1 is a perspective view showing a housing of a receptacle connector and a paddle board of a plug connector in accordance with a first embodiment of the present invention.
Figure 2:
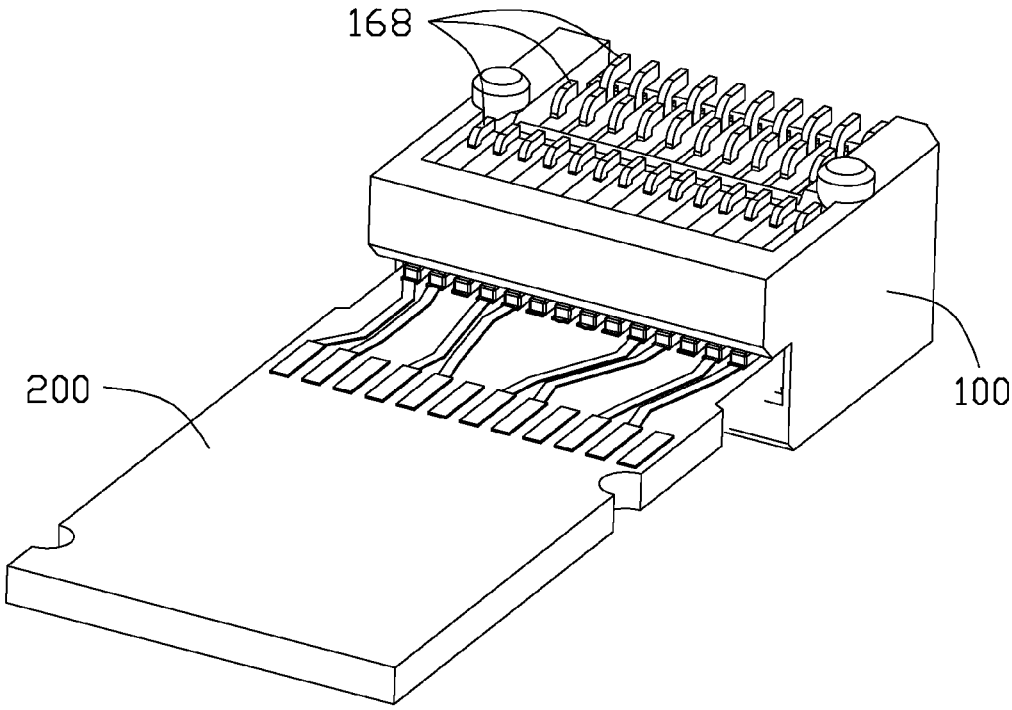
FIG. 2 is another perspective view similar to FIG. 1, taken from another aspect.
Figure 3:
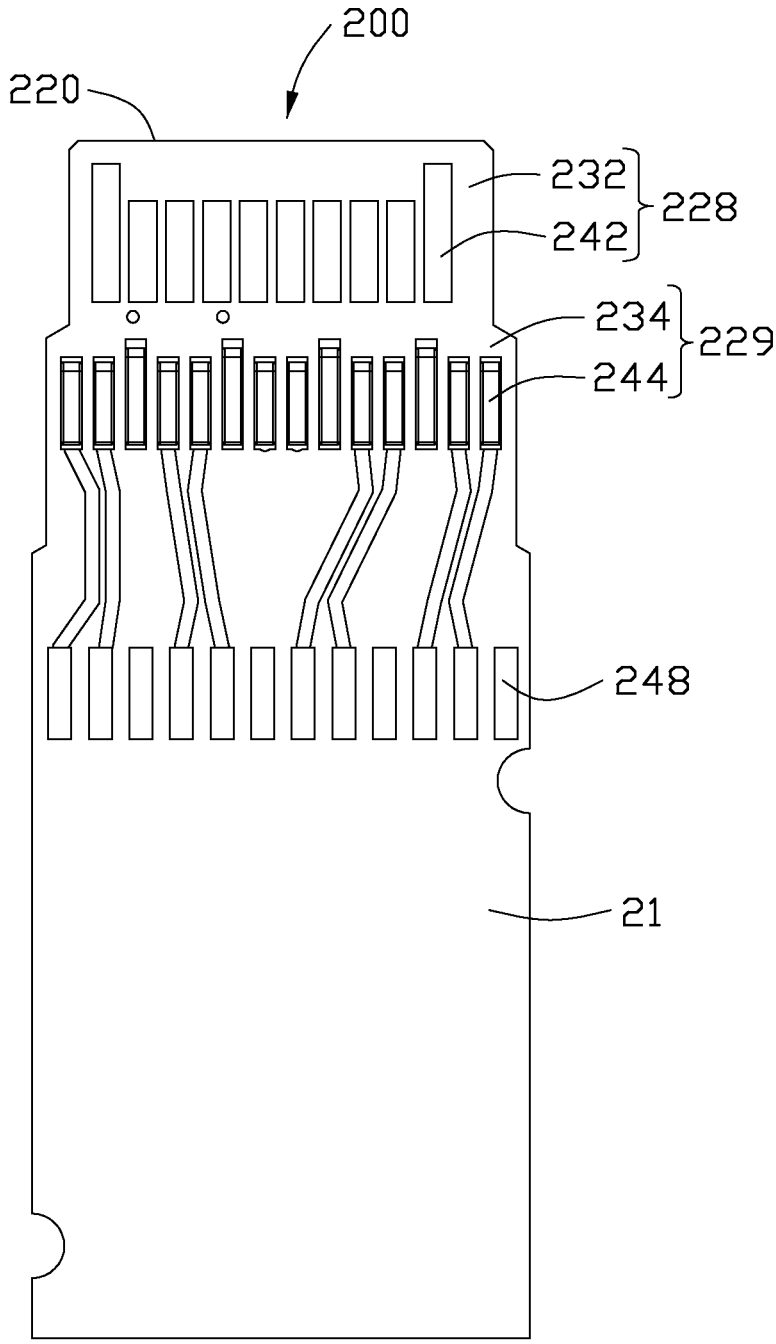
FIG. 3 is a top view of the paddle board shown in FIG. 1.
Figure 4:
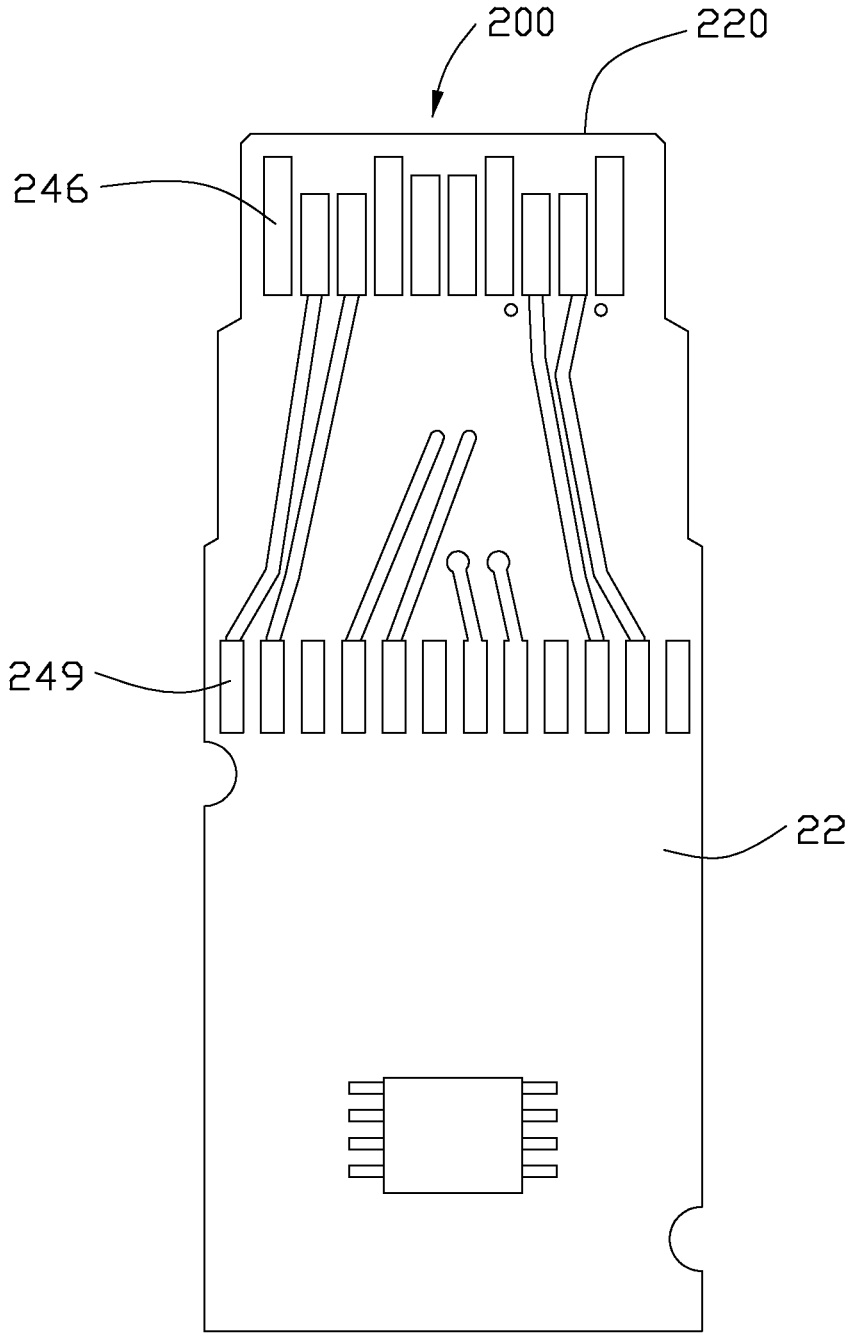
FIG. 4 is a bottom view of the paddle board shown in FIG. 1.
Figure 7:
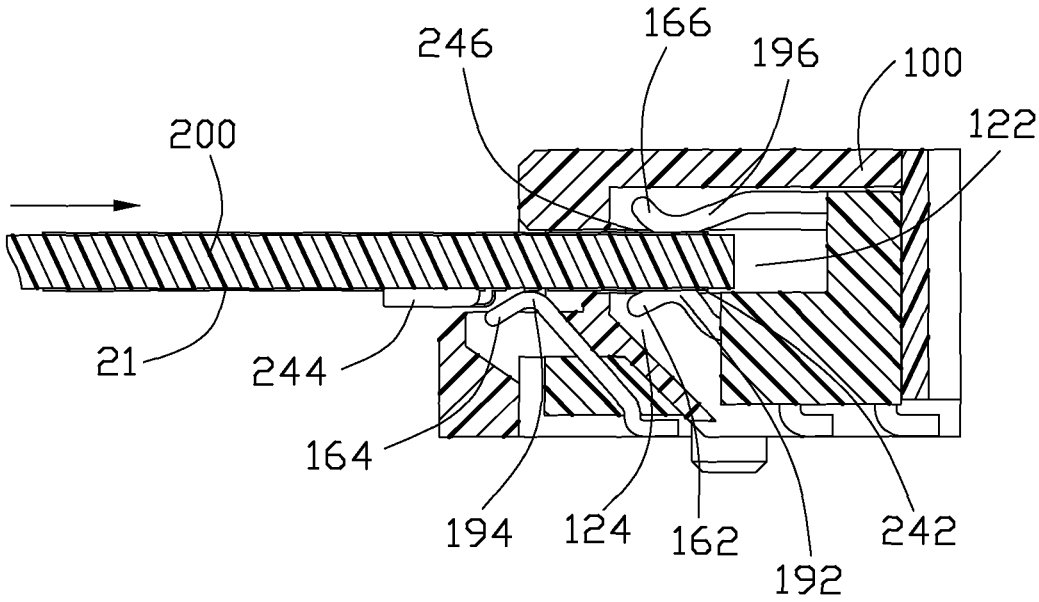
FIG. 7 is a cross-sectional view showing the paddle board partially inserted into the housing, taken along line 7-7 of FIG. 1.

Referring to FIGS. 3 to 4, the paddle board 200 is a print circuit board. The paddle board 200 has a first side 21, a second side 22 and a mating edge 220. The paddle board 200 has a first mating face 228 and a second mating face 229 at the first side 21. The first mating face 228 is closer to the mating edge 220 than the second mating face 229. The paddle board 200 has a row of first conductive pads 242 arranged on first mating face 228, and a row of second conductive pads 244 arranged on the second mating face 229. The paddle board 200 also has a row of third conductive pads 246 arranged at the second side 22 and adjacent to the mating edge 220. The row of first conductive pads 242 are separated from each other by a first insulative layer 232. The row of second conductive pads 244 are separated from each other by a second insulative layer 234. The second conductive pads 244 are higher than the first conductive pads 242 along a direction from the second side 22 to the first side 21. The paddle board 200 also has two rows of cable pads 248, 249 arranged behind these conductive pads 242, 244, 246 for electrically connecting the conductive pads 242, 244, 246 to the cable (not shown). These conductive pads 242, 244, 246 for mating with the receptacle 100 are capable of transmitting signal or grounding. As best shown in FIG. 7, the second conductive pads 244 are thicker than the first conductive pads 242.

Figure 5:
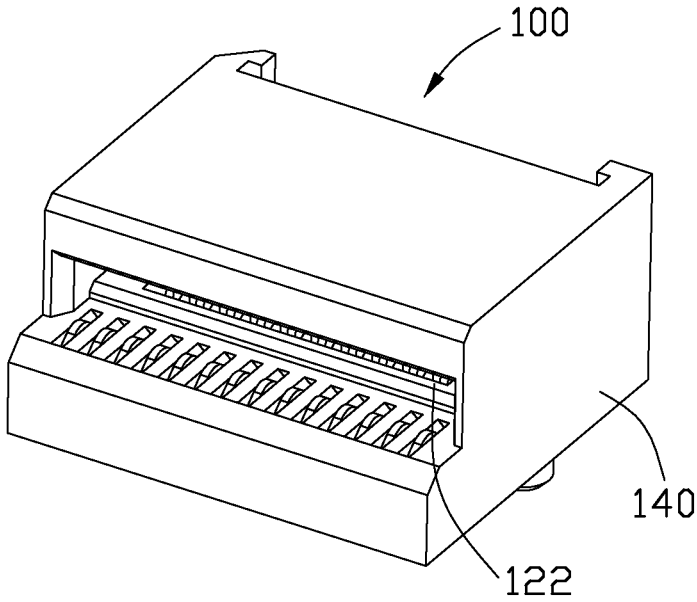
FIG. 5 is a perspective view of the housing shown in FIG. 1.
Figure 6:
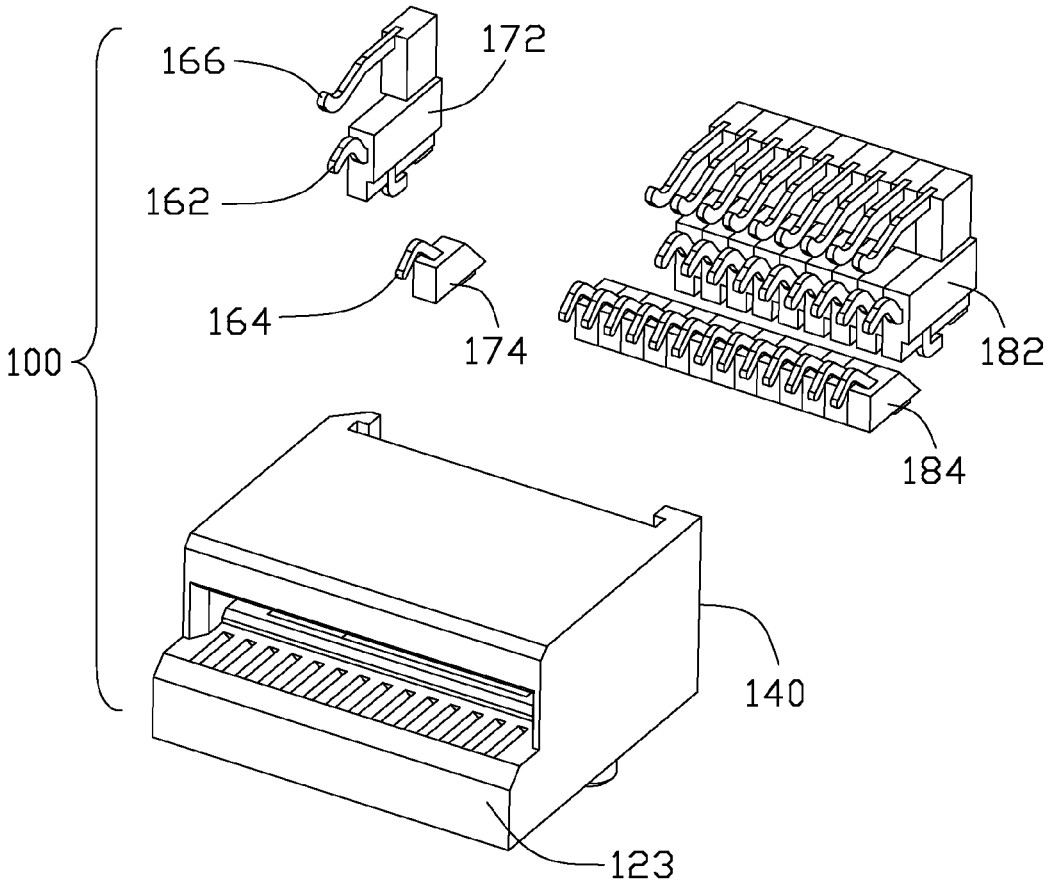
FIG. 6 is an exploded view of the housing shown in FIG. 5.

Referring to FIGS. 5-7, the receptacle 100 has a housing 140 defining an inserting slot 122 and a cavity 124 communicating with the inserting slot 122. The receptacle 100 has a plurality of contact modules received in the cavity 124 and secured in the housing 140. The contact modules have a row of second contact modules 184 and a row of first contact modules 182 disposed in front of the row of second contact modules 184 at the inserting direction. The first contact modules 182 and the second contact modules 184 are arranged transversely in the housing 140 and have a certain pitch therebetween. Each of the second contact modules 184 has a second terminal 164 insert-molded with a second insulative wafer 174. Each of the first contact modules 182 has a first terminal 162 and a third terminal 166 insert-molded with a first insulative wafer 172. The first terminal 162 has a first contact portion 192, the second terminal 164 has a second contact portion 194, and the third terminal 166 has a third contact portion 196. The first contact portion 192 and the second contact portion 194 are disposed at the lower side of the inserting slot 122. The third contact portion 196 is disposed at the upper side of the inserting slot 122. The housing 140 has a protrusion 123 in front of the inserting slot 122, and the second terminals 164 are secured at the protrusion 123. As best shown in FIG. 7, the second contact portion 194 is lower than the first contact portion 192 at the direction perpendicular to the inserting direction. These terminals 162, 164, 166 also have a plurality of mounting portions 168 extending outwardly from the housing 140 shown in FIG. 2.

Figure 8:
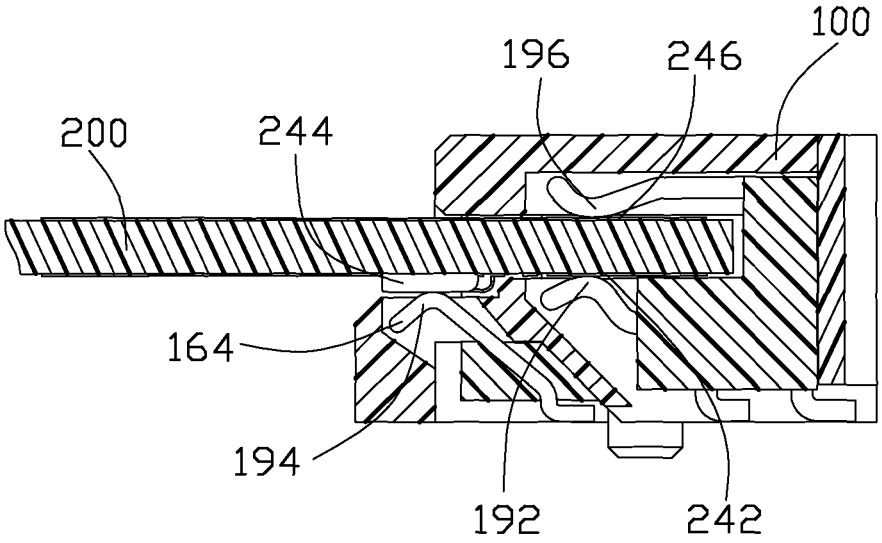
FIG. 8 is a cross-sectional view showing the paddle board inserted completely in the housing, taken along line 7-7 of FIG. 1.

Referring to FIGS. 7-8, in assembling of the paddle board 200 to the receptacle 100. The paddle board 200 has a first height at the first conductive pads 242 and a second height at the second conductive pads 244. The first height is smaller than the distance between the second contact portions 194 and a top wall of the housing 140, therefore, the paddle board 200 is capable of inserting into the receptacle 100 without contacting with the second contact portions 194 until the second conductive pads 244 engaging with the second contact portions 194. The paddle board 200 could insert easily into the receptacle 100 and avoid undesired engagement between the second contact portions 194 and the paddle board 200.

Figure 9:
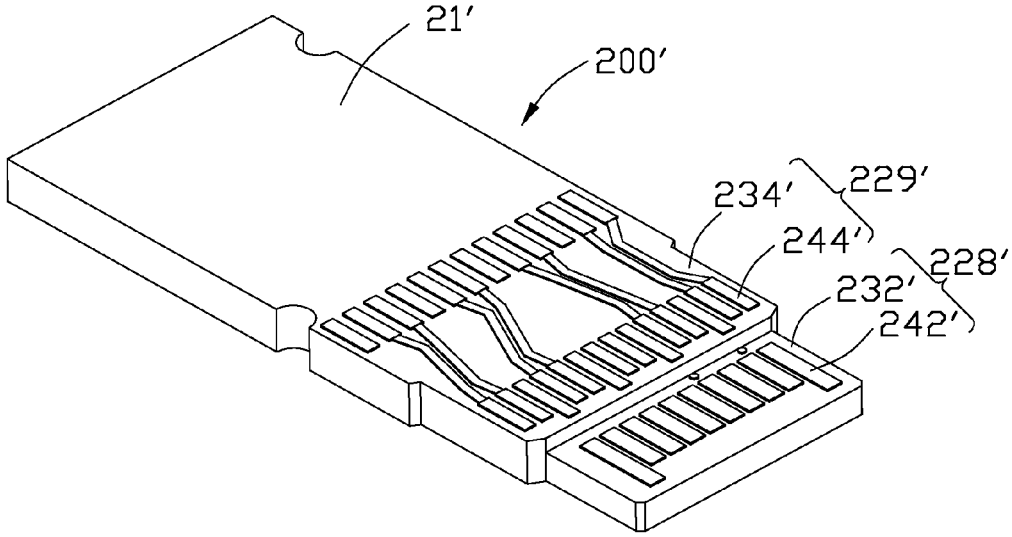
FIG. 9 is a perspective view showing a paddle board in accordance with a second embodiment.

Referring to FIG. 9, it shows a paddle board 200' of a second embodiment. The receptacle 100 and the second side 22 of paddle board 200 are same to that of the first embodiment. A row of first conductive pads 242' are separated from each other by a first insulative layer 232'. A row of second conductive pads 244' are separated from each other by a second insulative layer 234'. The first conductive pads 242' and the first insulative layer 232' are disposed at the a first mating face 228'. The second conductive pads 242' and the second insulative layer 232' are disposed at the a second mating face 229'. The second embodiment is different from the first embodiment in that the second mating face 229' is higher than the first mating face 228' on the first side 21'. The second conductive pads 244' have a thickness similar to that of the first conductive pads 242'. The second conductive pads 244' are higher than the first conductive pads 242' along the direction from the second side to the first side 21'.

Figure 10:
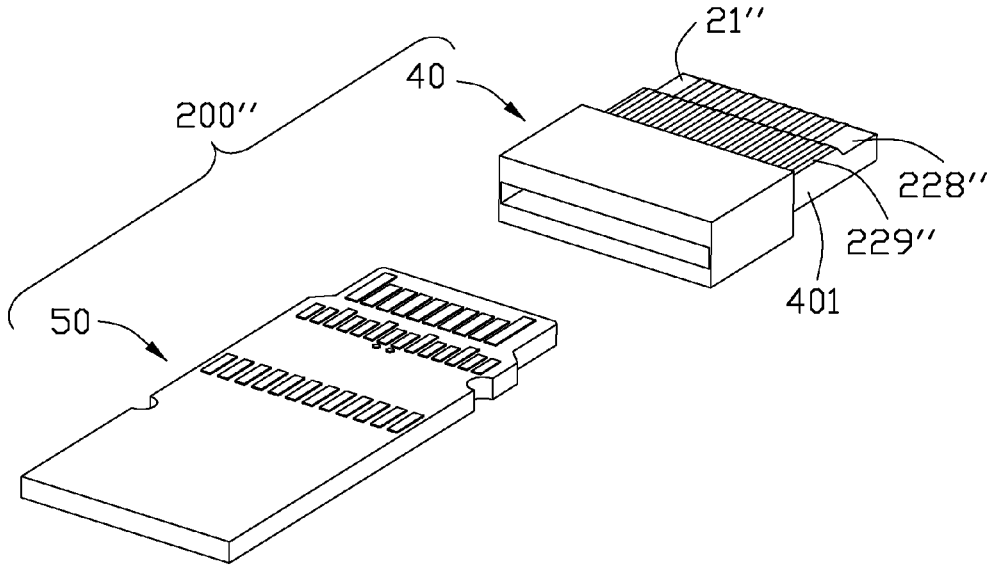
FIG. 10 is an exploded view showing a paddle board in accordance with a third embodiment.
Figure 11:
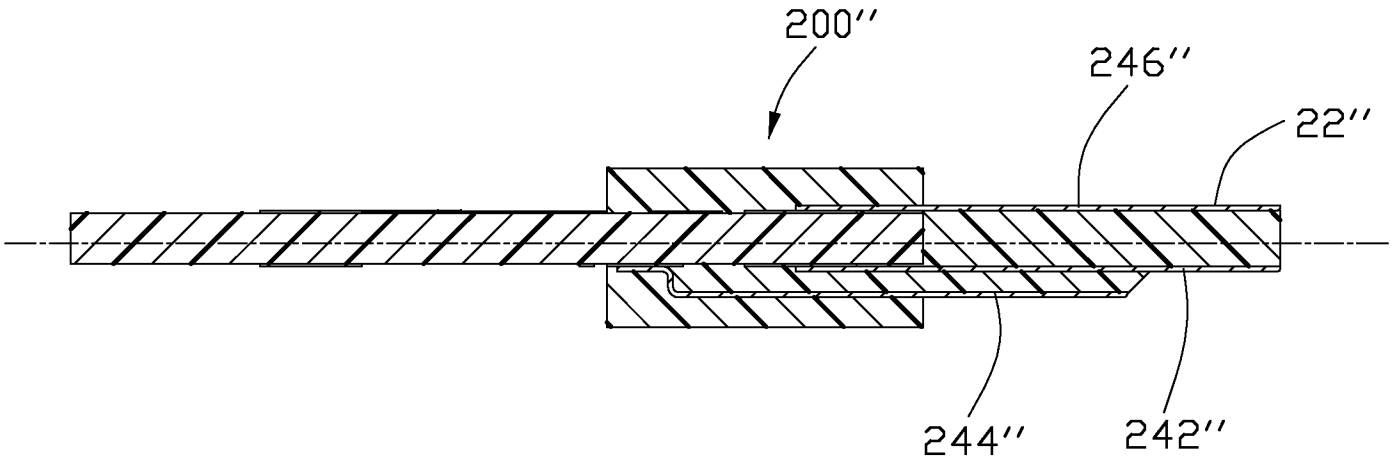
FIG. 11 is a cross-sectional view of the paddle board shown in FIG. 10.

Referring to FIGS. 10-11, it shows a paddle board 200" of a third embodiment. The paddle board 200" includes an adapter 40 and a circuit board 50 inserted into the adapter 40. The adapter 40 includes an insulative housing 401 and three rows of pins 242", 244", 246" insert-molded with the housing 401 and exposed to air. The adapter 40 has a first mating face 228" and a second mating face 229" higher than the first mating face 228". The pins 242", 244", 246" referred in the third embodiment are arranged like the conductive pads 242', 244', 246' referred in the second embodiment. The pins 242", 244", 246" include a row of first pin 242" and a row of second pins 244" disposed at a first side 21' of the adapter 40. The pins 242", 244", 246" also include a row of third pin 246" disposed at a second side 22' of the adapter 40. The second conductive pins 244" are higher than the first conductive pins 242" along the direction from the second side 22" to the first side 21". The circuit board 50 has a plurality of pads electrically connected to the pins 242", 244", 246". When the paddle board 200" is mated to the receptacle 100, the electrical connection between receptacle 100 and the paddle board 200" is pins-to-pins resulting in an impedance matching better than the electrical connection of pads-to-pins referred in the first and the second embodiments.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A connector assembly comprising a receptacle connector and a plug connector for mating with the receptacle connector, the plug connector comprising:

a paddle board having a bottom side; and a row of first conductive pads and a row of second conductive pads being exposed at the bottom side of the printed circuit board, the first conductive pads being disposed in front of the second conductive pads along an insertion direction of mating, wherein the second pad is thicker than the first pad; and the receptacle connector comprising:

a housing defining an inserting slot for insertion of the plug connector;

a row of first terminals each having a first contact portion extending upwardly into the inserting slot for mating with a corresponding first pad of the paddle board; and a row of second terminals each having a second contact portion extending upwardly into the inserting slot for mating with a corresponding second pad of the paddle board, wherein the second contact portion extends along a direction perpendicular to the insertion direction into the inserting slot up to a level lower than a level that the first contact portion extends along the same direction into the inserting slot.

2. A connector assembly comprising:

a receptacle connector and a plug connector for mating with the receptacle connector;

the plug connector comprising an adapter and a circuit board inserted in the adapter, the adapter having a front edge, a first mating face adjacent to the front edge, a second mating face behind the first mating face, the first and second mating faces being disposed at a lower side of the adapter, a plurality of insert-molded first pins exposed to the first mating face, and a plurality of insert-molded second pins exposed to the second mating face, wherein the second mating face is situated lower than the first mating face;

the receptacle connector comprising:

a housing defining an inserting slot for receiving the adapter;

a row of first terminals each having a first contact portion for mating with a corresponding first pin;

a row of second terminals each having a second contact portion for mating with a corresponding second pin;

wherein the first contact portion extends upwardly into the inserting slot a distance greater than a corresponding distance that the second contact portion extends.

3. The connector assembly as claimed in claim 2, wherein each of the second terminals is insert-molded with a wafer to form a contact module, and the contact modules are arranged transversely in the housing.

4. The connector assembly as claimed in claim 2, further comprising a row of third terminals each having a contact portion extending downwardly into the inserting slot to engage an upper side of the adapter.

5. The connector assembly as claimed in claim 2, wherein each of the first terminals and each of the third terminals are insert-molded with a common wafer to form a contact module, and the contact modules are arranged transversely in the housing.

6. The connector assembly as claimed in claim 2, wherein the housing has a protrusion in front of the inserting slot, the protrusion having a row of elongated slots for accommodating the second terminals.

* * * * *